US005314208A

United States Patent [19]

Strickland

[11] Patent Number: 5,314,208

[45] Date of Patent: May 24, 1994

[54] COMPREHENSIVE, PAR-RELATIVE GOLF SCOREBOARD

[76] Inventor: Ronald R. Strickland, 4508 Cove Rd., Wilmington, N.C. 28405

[21] Appl. No.: 958,568

[22] Filed: Oct. 8, 1992

[51] Int. Cl.[5] ..... B42D 15/00

[52] U.S. Cl. ..... 283/116; 283/49; 283/105; 283/102; 462/17

[58] Field of Search ..... 283/49, 105, 81, 102, 283/116; 462/17

[56] References Cited

U.S. PATENT DOCUMENTS

| | | | |
|---|---|---|---|
| 1,181,750 | 5/1916 | Edwards | 283/49 |
| 1,208,170 | 12/1916 | Lake | 283/49 |
| 1,224,452 | 5/1917 | Eaton et al. | 283/49 |
| 1,409,706 | 3/1922 | Goosman | 283/105 X |
| 1,499,287 | 6/1924 | Brewer | 283/105 X |
| 1,801,891 | 4/1931 | Wehler | 283/49 |
| 4,068,972 | 1/1978 | Stuart | 283/49 |
| 4,241,943 | 12/1980 | Malinovitz | 283/102 |
| 4,745,875 | 5/1988 | Timleck | 273/162 |
| 4,881,258 | 11/1989 | Ben-David | 283/102 |
| 5,190,319 | 3/1993 | Sandler | 283/102 |
| 5,197,922 | 3/1993 | Schubert | 462/17 X |

*Primary Examiner*—Paul A. Bell
*Attorney, Agent, or Firm*—Rhodes, Coats & Bennett

[57] ABSTRACT

A comprehension golf scorecard consisting of ROWS (19) for entering par-relative scores with or without pencil and ROW (10) for entering traditional gross scores or par-relative scores with pencil. SCRIBE-IN AREAS (2B), (6B), (13A), (15A), (16B) and PUNCH-OUT AREAS (2A), (6A), (6B), and (16B) provide a means for entry of scoring and identification data via the use of a golf tee or any scribe device. Scorecard is formatted to provide said comprehensive data and scores for up to four players on one card that will fit into a golfer's shirt or pants pocket. Punch-out scores and data are formatted so that scorecard is capable of being scored by electronic scanning and recording device.

9 Claims, 4 Drawing Sheets

COMPREHENSIVE, PAR-RELATIVE GOLF SCOREBOARD

FIELD OF THE INVENTION

This invention relates to a score card, for the game of golf, providing a comprehensive scoring means allowing the golfer a choice of par-relative scoring or gross scoring (with or without pencil or pen).

BACKGROUND

In the game of golf, scores are commonly recorded on a score card with pen or pencil. Said scoring provides for the recording of the total number of strokes played per hole and totals played for the total course (usually 18 holes). This scoring method is referred to as gross scoring. Prior art has recognized that keeping an operative pen or pencil during the course of a golf game is often troublesome and very inconvenient if the pen or pencil is lost or broken during the game. U.S. Pat. No. 4,745,875 (May 1988, Timleck) refers to this common problem. Timleck states in his "Purpose of the Invention": "It is an object of the present invention to provide a golfing scores recording device which is operative with the use of a common tee". Timleck's purpose, however, is not fully met because the only data recordable by the use of the tee is singular score punches made by the tee. The player's name, date, and gross score totals are not recordable by the use of Timleck's invention.

U.S. Pat. No. 1,224,452 (May 1917, Eaton) also addresses the aforementioned pencil loss problem with a pencil-less golf scorecard. Eaton's scorecard does provide for the recording of gross scores totals; however, Eaton's card does not provide for the pencil-less recording of pertinent data such as name and date.

U.S. Pat. No. 4,068,972 (January 1978, Stuart) scorecard uses a peg in a hole method. Neither Timleck's nor Stuart's scorecard can accommodate more than one player without using more than one card. Most public and private courses highly encourage playing in groups of four (foursome) to speed up play. Some courses require foursomes.

All said cards provide only for gross scoring data and do not provide a scoring means for more efficient par-relative data. Par-relative scoring refers to the total number of strokes in relation to par. Par refers to the number of strokes established as representative of an expert's score. A gross score of 5 on a par 4 hole is scored as a +1 (one over par) with par-relative scoring.

Most golfers think, calculate, and communicate golf scores in relation to par (i.e. par-relative). Most golf scoring jargon is in par-relative terms such as birdie (−1), eagle (−2), bogie (+1), and scratch (par). These par-relative idioms are more efficiently informative than gross scores since they relay a degree of proficiency without additional data. Also, golf handicaps are calculated in par-relative terms.

Both gross scoring and par-relative scoring methodology have their appropriate usages in golf. Golfers typically utilize both methods, Par-relative scores are used almost exclusively when communicating a score during a game. Either gross score or par-relative scores are used when communicating a completed game score. Some reasons that gross scores are not used exclusively by golfers are; 1. Gross scores are meaningless unless combined with additional information (for example, a gross score of 36 is relevant only if one knows the total par rating for the number of holes played), and; 2. Gross scores are harder to calculate. Par-relative scores are also easier addends and/or subtrahends to subtrahends to calculate than the gross score method of adding a series of larger numbers.

A golfer that plays a round of near par golf effectively has minimal mathematical computation if computing in the par-relative mode. For example, referring to the golf course represented in FIG. 1, if said golfer scores a round of fifteen pars on holes 1–15 and three bogies on holes 16–18, said golfer's par-relative score is easily calculated as 3 over par by simply ignoring the pars and adding the three bogies (1+1+1=3). Said, par-relative score is also easily converted to gross score by adding the 3 to the designated total par for the course, 72, giving a gross total score of 75. Whereas, if said golfer computed said score with solely gross score methodology, the computation would be a tediously long, addition problem (4+3+4+4+4+4+3+5+5+4+4+3+4+4+4+3+6-+6+5=75). Whereas said calculation is certainly not complicated, it is most assuredly tedious. Prior art golf score cards are designed for exclusively gross scoring, thus requiring the above tedious computations.

(Note: Hereafter, for ease of reading, all references to golfer(s) will be in the singular and all personal pronouns will be masculine.)

Neither Timleck, Stuart, nor Eaton provide for a score higher than 10 on any hole. Since all three said cards require one space for each score to be represented for each hole, a hypothetical maximum score of 10 is represented so that the card dimensions do not get too large. Although 10 is a reasonable maximum gross score, it is not uncommon for a golfer to score higher than 10.

PURPOSE OF THE INVENTION

It is a principle object of the present invention to provide a simple, inexpensive, golf scoring card that does not require the use of pen or pencil and provides for the recording of all necessary data required by golf tournaments, clubs, or associations.

It is an object of this invention to provide a comprehensive golf scorecard having a means for a golfer to record golf scores by either par-relative method, gross method, or a combination thereof.

It is an object of this invention to provide said comprehensive scorecard in a format that will accommodate up to four persons on a singular or singular folded card that easily fits into the golfer's shirt or pants pocket.

It is an additional object of this invention to provide for the entry of par-relative scores ranging from a hole in one to 10 over par on each hole, for each golfer. Said range is the equivalent to gross scores of 1–13 (on par 3 holes); 1–14 (on par 4 holes) and; 1–15 (on par 5 holes).

It is an additional object of this invention to provide a simplified, graphical lay-out that is easy to use, by a golfer, with average eyesight and dexterity.

It is an additional object of this invention to provide an optional punch-out or mark-out format so that the card is capable of being read by an electronic scanning device.

Further objects of this invention will become apparent from a consideration of the drawings and ensuing description.

Other objects of this invention will appear in the following description and appended claims, with reference being made to the accompanying drawings forming a part of the specification wherein like reference characters designate corresponding parts in the different drawings.

REFERENCE NUMERALS IN DRAWING

PLAYER #1 DATA AREA (2)
PLAYER #1 I.D. # [PUNCH-OUT] (2A)
PLAYER #1 NAME [SCRIBE-IN] (2B)
PLAYER #2 DATA AREA (3)
PLAYER #3 DATA AREA (4)
PLAYER #4 DATA AREA (5)
GOLF COURSE NAME (6)
DATE [PUNCH-OUT] (6A)
GOLF COURSE I.D. # [PUNCH-OUT] (6B)
HOLE NUMBER ROW (8)
HOLE NUMBER COLUMN(S) (9)
HOLE YARDAGE (9A)
HOLE PAR (9B)
PENCIL ENTRY ROW (10)
CIRCULAR INDENTION (11)
PERFORATED CIRCULAR INDENTION (11A)
TRI-FOLD CREASE (12)
FRONT-NINE GROSS TOTALS COLUMN (13)
FRONT-NINE TOTAL [SCRIBE-IN] (13A)
BACK-NINE GROSS TOTALS COLUMN (15)
BACK-NINE TOTAL [SCRIBE-IN] (15A)
COURSE GROSS TOTALS COLUMN (16)
COURSE GROSS TOTAL [PUNCH-OUT] (16A)
COURSE TOTAL [SCRIBE-IN] (16B)
PAR-RELATIVE SCORE ROWS (19)
PAR REFERENCE ROW (19A)
PUNCTURE-SHIELD (20)

DESCRIPTION

Figure 1:
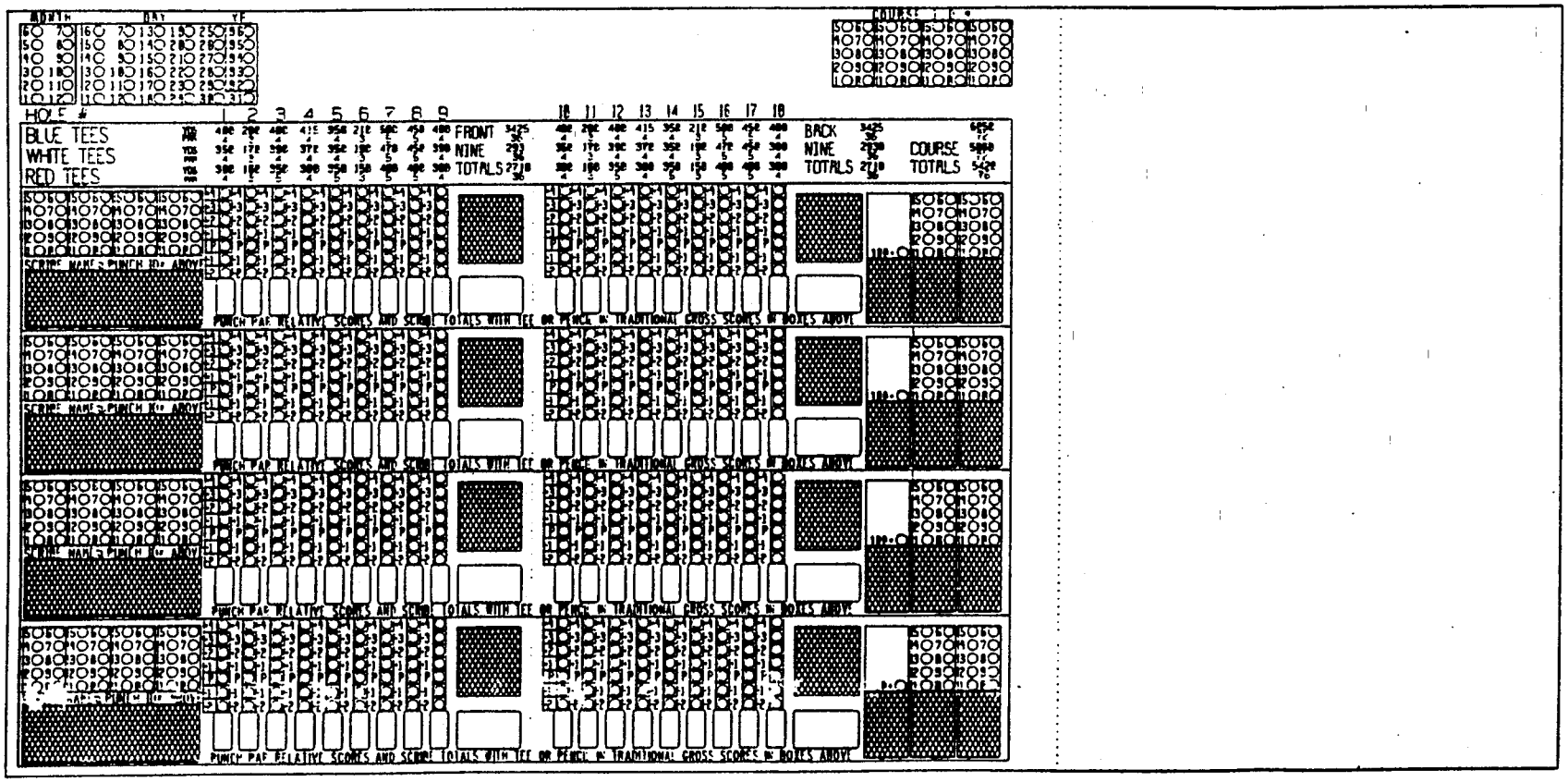
"FIG. 1" is a front elevation of a golf scorecard illustrating the present invention.
Figure 1A:
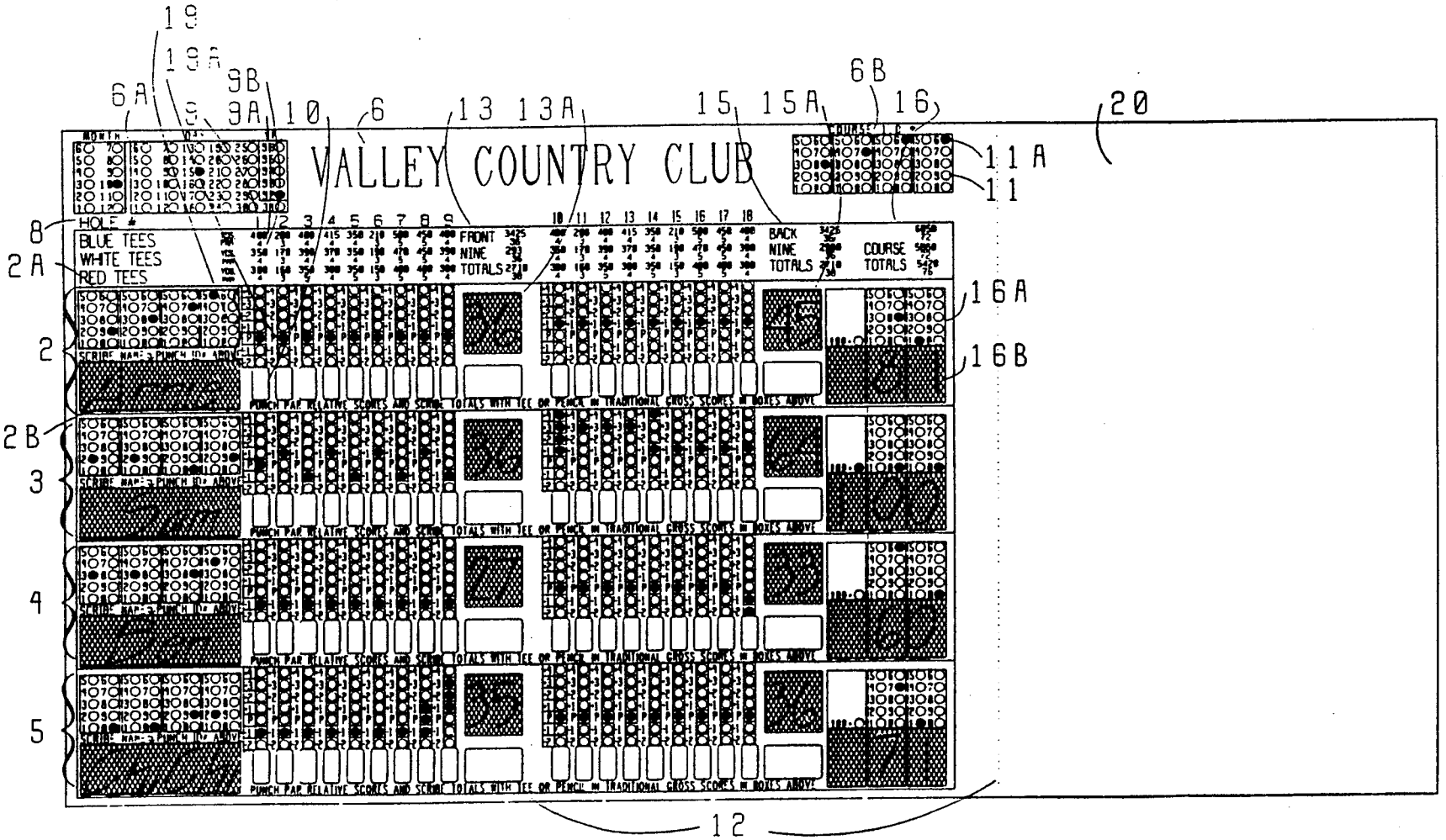
"FIG. 1A—PENCIL-LESS, PAR-RELATIVE SCORING" is a front elevation of said golf scorecard with hypothetical sample data and scores entered (scribed and punched), illustrating a hypothetical game of golf by four golfers utilizing the pencil-less, par-relative method.

Referring to the drawings, FIG. 1 shows the format of the score card. Said card may be made of card-paper or other sheet material capable of being perforated. Referring to FIG. 1A, a PUNCTURE-SHIELD (20); when folded between the other two folds protects the bottom fold from punches made on top fold. Folds are made at the TRI-FOLD CREASE (12). Also, SHIELD (20) adds to the rigidity of the scorecard, providing a foundation on which to write, scribe, or punch, facilitating the scoring of said scorecard.

In FIG. 1A, the uppermost row is for identification of the particular golf course being played. At the right end of said row is a GOLF COURSE I.D. # [PUNCH-OUT] (6B), showing, for example, an I.D. #8766. Centered on said row is an area for the GOLF COURSE NAME (6), showing, for example, "VALLEY COUNTRY CLUB". At the left end of said row is a DATE [PUNCH-OUT] (6A), showing, for example, Oct. 15, 1992. All areas of card that have small CIRCULAR INDENTIONS (11) will represent PUNCH-OUT areas. INDENTIONS (11) are referenced to the left with numerals representative of the numerical data to be recorded by punching out or marking out said representative indention. INDENTIONS (11) have a diameter of approximately 1.58 mm (1/16") and are designed so that said indentions can be perforated (punched out) with an ordinary golf tee or any scribe device. A PERFORATED INDENTION (11A) is shown.

Immediately under uppermost row; a HOLE NUMBER ROW (8) provides a row for headings for 18 vertical HOLE NUMBER COLUMN(S) (9), designated to identify vertical columns representing the first nine holes and the second nine holes of golf course. Rows and columns are arranged orthogonally. Under each COLUMN(S) (9) is representative HOLE YARDAGE (9A) and subscripted under YARDAGE (9A) is representative HOLE PAR (9B). There are three sets of HOLE YARDAGE (9A) and HOLE PAR (9B); each set is referenced horizontally to the left with the row title of "BLUE TEES", "WHITE TEES", and "RED TEES". Tee is defined as the area in which a golfer must strike his first stroke on each hole. Blue tees are usually placed furthermost from the hole, representing the longest yardage for each hole (usually played by the championship caliber players). White tees are usually placed in a position representing the second longest yardage for each hole (usually played by non-championship caliber males). Red tees are placed in a position representing the shortest yardage (usually played by the female golfers).

Representative yardage totals for the front-nine holes are orthogonally arranged in the respective rows, entitled "BLUE TEES", "WHITE TEES", and "RED TEES", in a FRONT-NINE GROSS TOTALS COLUMN (13). Additionally, there are yardage totals on said rows in a BACK-NINE GROSS TOTALS COLUMN (15), and in a COURSE GROSS TOTALS COLUMN (16) at the extreme right.

Still referring to FIG. 1A, PLAYER #1 DATA AREA (2) includes an area for a PLAYER #1 I.D. # (PUNCH-OUT) (2A) that provides a data entry means for player #1 to punch out or mark out up to a four digit I.D. code number (for example, I.D. #9875 is entered for Arnie). Data entry into I.D. # punch-out areas is required if scorecard is to be read and recorded by an electronic scanning device. Player #1 may scribe his name onto PLAYER #1 NAME (SCRIBE-IN) (2B) with a tee, pencil, or any scribe device. (SCRIBE-IN) (2B) and other areas FRONT-NINE TOTAL [SCRIBE-IN] (13A), BACK-NINE TOTAL [SCRIBE-IN] (15A), and COURSE TOTAL [SCRIBE-IN] (16B) are SCRIBE-IN areas. Said SCRIBE-IN areas are constructed in a manner, so that applied pressure from any sharp scribe object (including a golf tee) will leave a readable imprint. There are several preferred embodiments for said SCRIBE-IN areas;

not limiting to, but as follows: 1. a carbonless paper; 2. a scratch off topping similar to scratch and win coupons; 3. an indented hatch inscribed into paper or card material allowing for a visible scribed indention to be made with a common tee or any sharp object. Said hatch works similar to carpet nap changing shades of color depending on which way the nap is rubbed.

Up to three additional golfers can enter their respective names and data into sections PLAYER #2 DATA AREA (3), PLAYER #3 DATA AREA (4), and PLAYER #4 DATA AREA (5). To simplify description of said golf card, AREA (3), (4), and (5) are identical layouts as AREA (2); further description of scorecard will be limited to AREA (2), with implied duplicity and applicability to AREAS (3), (4), and (5).

In AREA (2), there are seven PAR-RELATIVE SCORE ROWS (19) representing seven par-relative scores ranging from 2 under par (−2) to 4 over par (+4). After completion of each golf hole, the player enters his score at the intersection of the appropriate COLUMN(S) (9) and the appropriate ROWS (19). The golfer records his par-relative score by perforating or marking out the appropriate CIRCULAR INDENTIONS (11). To assist golfers in quick identification of the appropriate ROW (19), a PAR REFERENCE ROW (19A), representing a score of par, is highlighted by color, fill or hatch pattern, shade differential, or bold borders and is further indexed laterally by the letter "P". ROW (19A) is the horizontal row on which to enter a score of par. ROW (19), immediately above ROW (19A), is for entering scores of one over par and indexed to the left with +1. The second row above said ROW (19A) is for two over par (+2), and so on, up to four over par (+4). Rows under ROW (19A) are for under par scores. Cumulative punches may be made to enter scores higher than four over par (+4), and for scores lower than two under par (−2). Corrections in erroneously punched scores can be made by appropriate, cumulative punches. For example, an erroneously punched +2 can be cancelled by punching a −2.

At the completion of each nine holes of golf, the player calculates his total, gross score by adding his cumulative, par-relative scores to the appropriate PAR (9B) total in COLUMN (13) and COLUMN (15). Then the player records his total gross score by inscribing, in the appropriate areas, as follows: Front-nine-total score is inscribed in [SCRIBE-IN] (13A), back-nine-total score is inscribed in [SCRIBE-IN] (15A), and course-total score is inscribed in [SCRIBE-IN] (16b). Optionally, player can punch out or mark out matching score in area COURSE GROSS-TOTAL [PUNCH-OUT](-16A). A PENCIL ENTRY ROW (10) is for the golfer who prefer to enter either gross scores or par-relative scores with a pen or pencil. The smaller filleted-rectangular boxes in ROW (10) aligned orthogonally under individual hole COLUMN(S) (9) provide for individual hole scores. The two larger, filleted-rectangular boxes, in ROW (10), are aligned orthogonally under COLUMN(S) (13) and (15), for respective nine-hole gross totals. SCRIBE-IN (16B), although designed for pencil-less scribing, is also suitable for penciling course total.

OPERATION

Figure 1B:
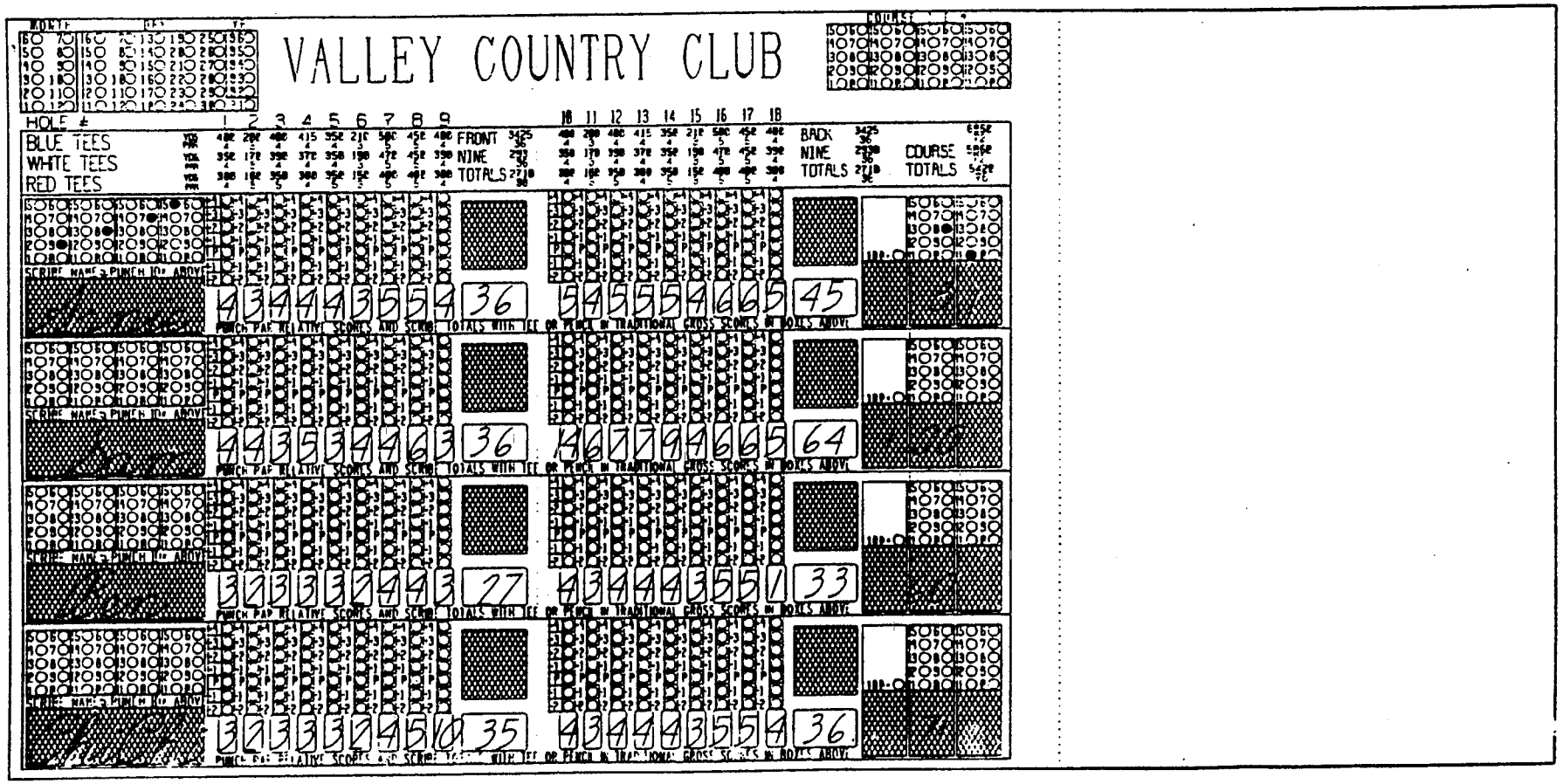
"FIG. 1B—PENCILED, GROSS SCORING" is a front elevation of said golf scorecard with sample data and scores entered (written with pencil), illustrating the same hypothetical game of golf as in FIG. 1A except the golfers pencil their scores using the traditional gross score method.
Figure 1C:
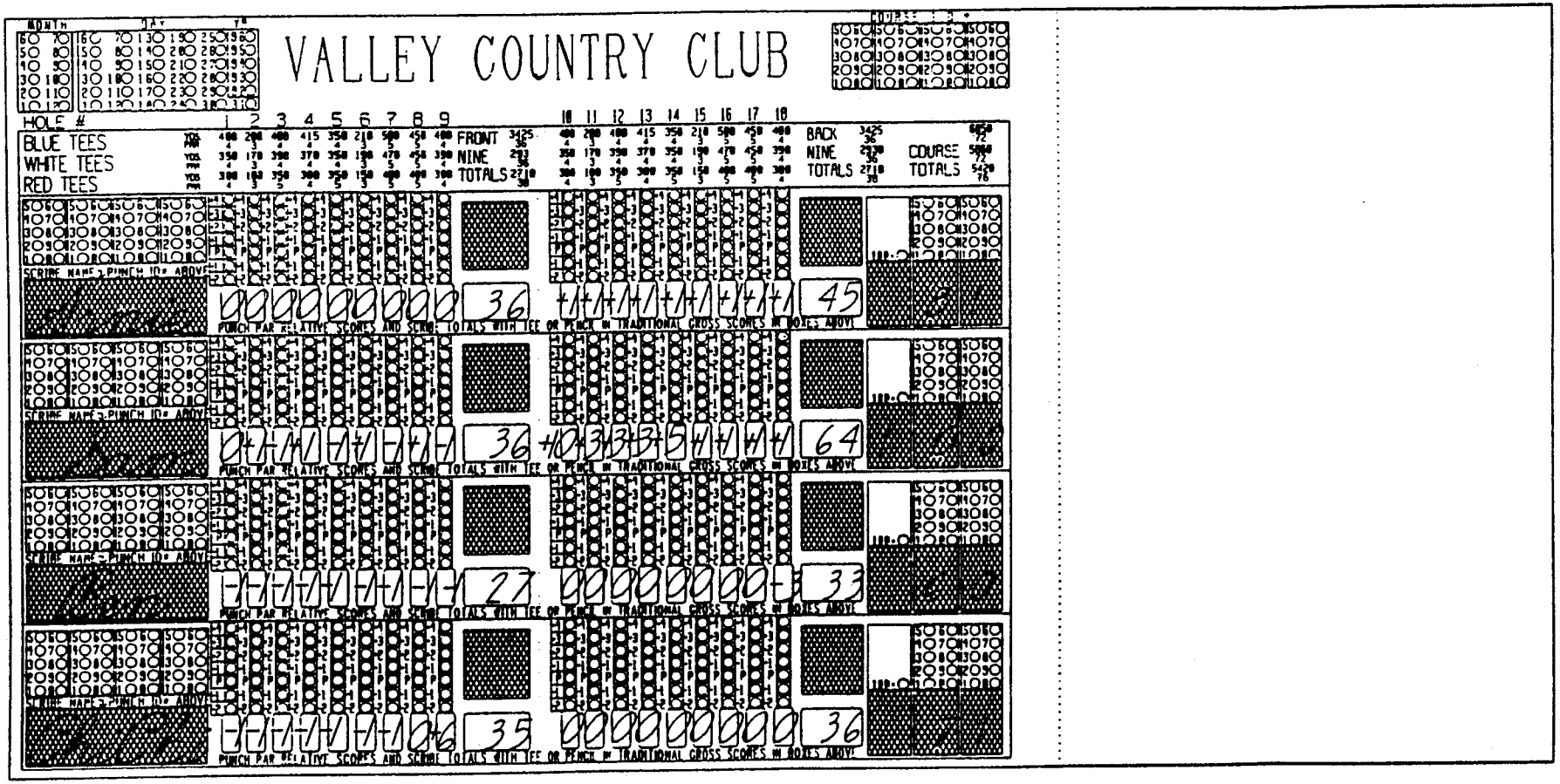
"FIG. 1C—PENCILED, PAR-RELATIVE SCORING" is a front elevation of said golf scorecard with sample data and scores entered with pencil, illustrating the same hypothetical game of golf as in FIG. 1A except the golfers pencil their scores using par-relative scores.

FIG. 1A, FIG. 1B, and FIG. 1C represent a hypothetical game of golf. The purpose of drawings FIG. 1A, FIG. 1B, and FIG. 1C is to provide a comparison of three different scoring methods. FIG. 1A represents said card scored by pencil-less par-relative methodology. Scores are punched and scribed. FIG. 1B represents said card scored by traditional, gross methodology with a pencil. FIG. 1C represents said card scored by par-relative methodology with the use of a pencil instead of a tee. Said hypothetical game represents a wide range of scoring combinations including a hole in one (Ben, Hole #18), a gross score of 14 (Sam, Hole #10), and other varied combinations that are used to help exemplify the utility, flexibility, and comprehensiveness of said scorecard.

Referring to FIG. 1A, Arnie's front-nine scores of nine consecutive pars can be recognized and scored at a glance with the visual aid of PAR REFERENCE ROW (19A). Par for the front-nine is 36 [intersection of "WHITE TEES" row and COLUMN (13)]. Therefore, Arnie's front-nine gross total score, 36, requires minimal calculation and is scribed into [SCRIBE-IN] (13A). Sam's front-nine scores can be tallied at a glance since four bogeys ($4\times1=+4$) and four birdies ($4\times-1=-4$) mathematically cancel each other out. Sam's Hole #1 score is a par (0), so his front-nine total-gross score is also quickly calculated at 36 (i.e., front-nine par total). Ben's nine consecutive birdies, on the front-nine holes, also can be quickly tallied; nine under par (−9) subtracted from 36 equals 27. Chichi's seven birdies (−7), a par (0), and a six over par (+6) is easily mentally tallied as follows: $(-7)+(0)+(+6)=(-1)+(36)=35$. On the ninth hole, the six over par (+6) is scored by cumulative entries (i.e. +1, +2, and +3 are all punched or marked) to enable scoring of a higher score than +4. On hole #8, ChiChi has also corrected an erroneously entered −1 by entering a +1 and then punching the correct entry of par.

To further demonstrate comprehensiveness and flexibility of golf card; Ben scored a hole in one(−3 on a par 4 hole) on the 18th hole, (scored by cumulative punch-outs). Also, Sam's 10th hole score of +10 is scored by cumulative punch-outs of +1, +2, +3, and +4. This par-relative score of +10 is the equivalent to a gross score of 14, the highest score that can be recorded (via punch-outs) on a par 4 hole. Unlikely higher scores would have to be recorded on ROW (10) with a pencil.

Combinations of methodology are workable. For example, a golfer choosing the traditional gross method (with pencil) can switch to the pencil-less, par-relative, method if he loses his pencil during a game. Regardless of method or combinations of methods used, if player wants his score recorded by electronic scanning device, he punches or marks his I. D. # in area (2A) and course totals in the COURSE TOTAL SCORE (PUNCH-OUT) (16A). Said punched or marked-out course total (2A) matches the scribed-in total in (16B). For example, referring to FIG.1B, even though Arnie has kept his score by penciled, gross method, he can have his scorecard read and recorded by electronic scanning device because he has punched (or marked) out the minimum said data [(2A) and (16A)].

I claim:

1. A golf-scoring card comprising:

(a) a planar member; and (b) at least one scoring panel on said-planar member including an array of perforated holes for recording golf scores over a plurality of golf holes, said array including a series of perforated holes for each golf hole with each perforated hole in a series representing a different score so that a golf score is recorded by punching out a corresponding perforated hole in a respective series in said array; and (c) one or more scribe-in areas covered with an etchable medium capable of being inscribed by a scribing instrument.

2. The golf-scoring apparatus of claim 1 wherein the scribe-in areas include a first scoring area associated with a first group of golf holes and a second scoring area associated with a second group of golf holes.

3. The golf-scoring apparatus of claim 2 wherein the scribe-in areas further include a third scoring area associated with both the first and second group of golf holes.

4. The golf-scoring apparatus of claim 3 wherein the scribe-in areas further include a name area for recording the name of a golf player.

5. The golf-scoring apparatus of claim 1 wherein said etachable medium is a thin scratch-off film.

6. The golf-scoring apparatus of claim 1 wherein each scribe-in area includes a carbonless paper.

7. The golf-scoring apparatus of claim 1 wherein each scribe-in area includes an indented hatch.

8. The golf-scoring apparatus of claim 1 wherein the planar member is divided into a plurality of panels including a first scoring panel having a first scoring array for a first group of golf holes, a second scoring panel having a second scoring array for a second group of golf holes, and a guard panel, wherein the panels are foldable along respective fold lines to position the guard panel between the first and second scoring panels so as to protect one scoring panel while a player marks the other scoring panel.

9. A golf-scoring apparatus comprising:

(a) a planar member having two scoring panels and a guard panel joined edge-to-edge with fold lines dividing adjacent panels;

(b) a first one of said scoring panels including an array of perforated holes for recording golf scores in a first group of golf holes, said panel including a series of perforated holes for each golf hole in said group with each holes in a series corresponding to a different score so that a golf score is recorded by punching out a corresponding hole in a respective series in said array;

(c) a second one of said scoring panels including an array of perforated holes for recording golf scores in a second group of golf holes, said array including a series of holes for each golf hole in said group with each hole in a series corresponding to a different score so that a golf score is recorded by punching out a corresponding hole in a respective series in said array; and (d) wherein said guard panel is foldable to a position between said first and second panels to protect each of the scoring panels when the other scoring panel is being punched.

* * * * *